US005114746A

United States Patent [19]

O'Leary et al.

[11] Patent Number: 5,114,746

[45] Date of Patent: May 19, 1992

[54] CABLE COATED WITH AT LEAST TWO CONCENTRIC LAYERS OF POLYMERIC MATERIAL AND PROCESS OF MAKING SAME

[75] Inventors: John O'Leary, Northcote; Erik Adams, Kensington, both of Australia

[73] Assignee: ICI Australia Operations Proprietary Limited, Melbourne, Australia

[21] Appl. No.: 446,565

[22] Filed: Dec. 7, 1989

[51] Int. Cl.[5] ..... B05D 5/12

[52] U.S. Cl. ..... 427/118; 174/120 R; 174/120 SR; 427/163; 427/407.1; 428/375

[58] Field of Search ..... 427/118, 163, 407.1; 174/120 R, 120 SR; 428/375

[56] References Cited

U.S. PATENT DOCUMENTS 4,820,561 4/1989 Pithouse et al. ..... 428/34.9 X 4,877,660 10/1989 Overbergh et al. ..... 428/34.9

*Primary Examiner*—Michael Lusignan

*Attorney, Agent, or Firm*—Cushman, Darby & Cushman

[57] ABSTRACT

An abrasion- and termite-resistant cable comprises at least one elongate functional element coated with at least two concentric layers of polymeric material, the exterior layer being a polyamide and the layer adjacent thereto being an essentially olefin polymer which comprises from 0.001 to 30% by weight of polar monomer selected from unsaturated acids and acid anhydrides. Other monomers and properly-modifying polymers may also be present in the olefin polymer. These layers are applied in a single operation wherein at least one of the polymeric materials is in a fluid state when the materials are contacted.

The invention permits the construction of a cable with an unusally thin polyamide layer. It also permits the extrusion of the layers on an aluminium-sheathed functional element without the need for an adhesion-promoting layer on the aluminium.

24 Claims, No Drawings

CABLE COATED WITH AT LEAST TWO CONCENTRIC LAYERS OF POLYMERIC MATERIAL AND PROCESS OF MAKING SAME

This invention relates to cables, and particularly those which are to be laid underground.

Cables are elongate, flexible rods used as carriers for electrical power or electrical or optical communications signals. A cable commonly comprises at least one elongate functional element (such as an electrical wire or an optical fibre) which is surrounded by a protective sheath or jacket, commonly of a plastics material. A particularly good material is polyethylene; it has excellent insulation and physical properties, it is relatively inexpensive and it is easily applied to the conductor by extrusion.

It has been found, however, that in some countries, polyethylene-coated cables which are laid underground are susceptible to attack by certain species of ground-dwelling insects, notably ants and termites, and this leads ultimately to failure in service. A further problem which is universal is the lack of abrasion resistance of polyethylene; this can lead to severe damage when, for example, a cable is pulled through a conduit. One method of combatting these problems is to coat the polyethylene with a relatively insect- or abrasion-proof material, examples of suitable materials being polyamides such as polyamides 11 and 12 which are both abrasion-resistant and relatively unaffected by formic acid. This process makes the cable more expensive as a second extrusion operation has hitherto been required to add the polyamide layer. In addition, it has been found that, in order to cover discontinuities and to prevent buckling damage to the cable when it must be bent, the layer of insect-proof material must be quite thick. This, of course, contributes more expense.

It has now been found that it is possible to produce a cable which is abrasion-resistant, insect-proof and which substantially avoids the deficiences of the known art. There is therefore provided, according to the present invention a process of manufacture of a cable comprising at least one elongate functional element which is coated with at least two concentric layers of polymeric material, the exterior layer comprising at least one polyamide of high surface gloss, hardness and resistance to formic acid, and the inner layer immediately adjacent to the exterior layer comprising essentially olefin polymer which comprises from 0.001% to 30.0% by weight of polar monomer selected from unsaturated acids and acid anhydrides, the layers being applied in a single operation wherein at least one of the polymeric materials is in a fluid state when the two polymeric materials are contacted.

It has been found that, using this technique, it is possible not only to reduce the trouble and expense of having to perform a double extrusion process (as currently practised by the art), but also to produce a cable which can be bent without damage, yet which has a substantially thinner polyamide layer. The invention therefore also provides a cable which comprises at least one elongate functional element which is coated with at least two concentric layers of polymeric material, the outer layer comprising at least one polyamide of high surface gloss, hardness and resistance to formic acid, and the inner layer adjacent to that outer layer comprising essentially olefin polymer which comprises from 0.001% to 30.0% by weight of polar monomer selected from unsaturated acids and anhydrides, the outer layer being less than 2 mm thick. In a more preferred embodiment, the outer layer has a thickness of less than 0.5 mm and in an especially preferred embodiment the outer layer has a thickness of less than 0.25 mm.

The cables to which this invention is directed are cables comprising at least one elongate functional element. The functional element may be, for example, a single elongate piece of electrically conducting material or optical fibre, or it may be a number of such pieces. In the case of a number of such pieces, they may lie together in physical contact when they are to carry the same power or signals, or they may be separate if they are to carry different power or signals. In the case of those carrying a single electrical signal, they may be grouped together for ease of handling. For those which are separate, they may be placed in any suitable relation to one another. For example, if they have their own individual insulating sheaths, these may touch along their length. If they do not have individual insulating sheaths, they may be spaced apart by any convenient means. It is not necessary that the cable be circular in cross section (although this is commonly the case), and if there are two or more conductors which may not contact each other, they may be laid out in a planar arrangement. The person skilled in the art will appreciate that there are many possible embodiments, all of which lie within the scope of this invention.

The outer layer of the cable of this invention, that is, the layer which is in contact with the environment in which the cable will perform its function, comprises at least one polyamide. The physical properties required of such an outer layer, such as surface hardness, gloss, flexibility and resistance to abrasion, water and formic acid, are well known and knowledge of these will enable the skilled person to select a suitable outer layer. It is preferred that the outer layer shall comprise at least 70% by weight of polyamide. It is possible, of course, to use a blend of polyamides or a blend of a polyamide or polyamides with a polyolefin or polyolefins, but it has been found that polyamide 12 is a particularly useful material and provides an entirely adequate layer on its own.

The inner layer immediately adjacent to this outer layer comprises essentially olefin polymer, that is, polymer wherein at least 70% by weight of the polymer is provided by olefin monomeric units. These can be selected from any olefin monomers known to the art, bearing in mind the desired properties of the cable and fabrication requirements of the process. This dictates a high proportion (at least 70% by weight) of $C_2$–$C_4$ monomer units, preferably with a predominance of ethylene units. Preferred olefin polymers include low density polyethylene (LDPE), linear low density polyethylene (LLDPE), high density polyethylene (HDPE), polypropylene (PP) and ethylene copolymers which comprise a minor proportion (up to 30% by weight) of non-olefinic monomers such as vinyl acetate, methyl methacrylate, ethyl acrylate and butyl acrylate. It has been found that ethylene-vinyl acetate (EVA) copolymers give especially good results and these are the preferred olefin polymers.

The olefin polymer comprises from 0.001% to 30.0% by weight, more preferably from 0.001% to 5.0% by weight and most preferably of 0.01 to 5.0% by weight, of polar monomer selected from carboxylic acids and anhydrides. In choosing a polar monomer and a proportion, it must of course be borne in mind that there are limits to the extent to which certain polar monomers may be copolymerised with olefins and olefin polymers. For example, it is possible to polymerise 30% of acrylic acid with ethylene, but it is not possible to polymerise more than about 5% of maleic anhydride with ethylene. The skilled person will of course realise this and choose accordingly, and this limitation is implicit in the invention. These polar monomers can be selected from the range known to the art and include materials such as maleic and fumaric acids and maleic anhydride, and acrylic and methacrylic acids.

The polar monomers are preferably copolymerised with an olefin polymer for use in the invention, but they may also be block or randomly copolymerised with alkene monomers to give a suitable olefin polymer. Two such olefin polymers may be mixed, provided the overall proportion of polar monomer remains within the limits set out hereinabove. In an especially preferred embodiment of the invention, polar monomer and olefin monomer are copolymerised to form a "concentrate", that is, a copolymer with a high proportion of polar monomer, and this concentrate is then blended with an olefin polymer containing no polar monomer. The concentrate may be a conventional copolymer, or it may be a graft copolymer wherein a polar monomer is graft copolymerised on to an olefin polymer.

In a further embodiment of the invention, there may be added to the olefin polymer other polymers which serve to introduce property modifications such as enhanced resistance to impact damage and environmental stress cracking. These polymers, which are present to the extent of less than 50% by weight of the olefin polymer, include thermoplastic rubbers such as styrene block copolymers such as SBS, EPR, EPDM and butyl and urethane rubbers. In addition to these, both polymeric layers may comprise standard additives such as plasticisers, present in art-recognised quantities.

In the process according to the present invention, the outer layer and the inner layer adjacent thereto are applied to the functional element or elements in a single operation. The subject of the coating operation may be a functional element or functional elements in simple form or covered in metallic foil or polymeric material. The two layers are then simultaneously or consecutively applied by any convenient manner such that at least one of them is fluid when they contact. This may be achieved, for example, by coextrusion, wherein the layers of polymer are brought together within a die while both are still in a fluid state. It may also be achieved by using two separate extrusion dies with the functional element or elements being initially coated with the olefin polymer, then with the polyamide layer, prior to quenching and complete solidification of the inner layer. In a preferred process, the two layers are extruded from a single die within which they are combined under pressure. It has been found that the best results are given by using this method.

It is preferred that, if only one polymer is fluid, it be the olefin polymer. It is also preferred that, when the two layers meet, the olefin polymer should be at a temperature of at least 180° C., more preferably 220° C.

It is a special feature of this invention that it works particularly well when the cable is to comprise a functional element covered in aluminium foil. A typical procedure for manufacturing such a functional element is firstly to coat the functional element in a waterproofing jelly, then to bind a coating tape on to the coated element and finally to coat the taped element in the foil. (In some procedures, the taping stage is omitted). In known processes for coating such elements, the aluminium is coated with an adhesive layer which permits the polyolefin layer to adhere to it. This introduces a further step into the process and thus increases the process time and expense. The inner layer of essentially olefin polymer of this invention can be coated directly on to uncoated aluminium, and thus it permits a one step process according to this invention for the coating of functional elements which are surrounded by uncoated aluminium. The invention thus provides such a process and the cable produced thereby.

In a further embodiment of the invention, the process of the preceding paragraph may be carried out, but omitting the aluminium completely, that is, the polymeric layers are deposited directly on to the taped functional element. This has obvious cost advantages, but was previously not possible because of the possibility of migration of the jelly to the interface of the polyamide and the underlying polymer, this often leading to difficulties when cables have to be joined or spliced. The cables prepared according to the present invention do not suffer from this defect. In this embodiment, the preferred tapes are made from polyester, polypropylene or polyamide.

The cables of the present invention have all of the useful properties of known cables, but they have the major advantage of being insect-resistant and therefore the guarantee of longer service life. The excellent properties of the cables of this invention are of course advantageous in areas which do not suffer from problems with insects. The high abrasion resistance of the polyamides ensures that the cables can tolerate much rough handling without incurring function-impairing damage. They can be bent to radii much smaller than can known cables, without suffering damage. They also have the additional advantage that they are cheaper than known insect-resistant cables in that the nylon layer can be thinner than that on known cables, and in that only one extrusion pass is required to manufacture the cable. When aluminium foil is used as a sheathing material, there is the additional advantage referred to hereinabove that this need not have an adhesive coating.

The invention is further illustrated by the following examples.

EXAMPLE 1

Manufacture of a Cable According to the Invention

A modified polyethylene was prepared by blending and extruding in the molten state a branched LDPE and a graft ethylene-maleic anhydride copolymer ("Modic" (trade mark) L100F was used) in the ratio (LDPE: copolymer) of 4:1. This material was again extruded from a die on to an electrical cable sheathed in uncoated aluminium. The temperature of the polymers at the time of contact was above 180° C. As this was being done, polyamide 12 (Ube 3020LU1 was used) was extruded from a concentric die over the olefin polymer to give a layer of 0.2 mm.

After cooling, the coating proved to be tough and uniform and there was excellent adhesion between all of the various layers, such that no delamination occurred after cooling or on subsequent flexing of the cable.

EXAMPLE 2

A Comparative Example Illustrating the Effect of Changing the Proportion of Polar Groups A series of blends of polyethylene and a graft ethylene-maleic anhydride copolymer ("Modic" L100F as used in the previous example) were co-extruded with polyamide 12 (Ube 3020LU1) on a co-extrusion blow moulder. In this process, both polymeric materials were at temperatures in excess of 180° C. at contact. The resulting films were cut into strips and subjected to the peel test of Standard No. D4565 of the American Society of Testing and Materials, this providing a good indication of the tenacity of the bond between the inner and exterior layers of a cable. The results were as follows:

| % "Modic" L100F | % Maleic Anhydride | Peel Strength (N/mm) |
|---|---|---|
| 15 | 0.006 | 0.04–0.05 |
| 20 | 0.008 | 0.05–0.06 |
| 25 | 0.01 | 0.07–0.13 |
| 30 | 0.012 | 0.29–0.45 |

These results can be regarded as very good, the lower level of acceptability of this test being 0.005–0.02 N/mm.

EXAMPLE 3

Use of Acrylic Acid as Polar Monomer

A blend of polyethylene with 91.7% by weight of the mixture of ethylene-acrylic acid copolymer was co-extruded with polyamide 12 as described in Example 2. The ethylene-acrylic acid copolymer used was "Primacor" (trade mark) 1410, which comprises about 9% by weight of acrylic acid—the quantity of polar monomer present was therefore about 8.25%. When subjected to the peel test of Example 2, the sample exhibited cohesive failure, that is, the polyethylene layer failed before the interface did.

The example was repeated, but lowering the quantity of ethylene-acrylic acid polymer to 55% (about 4.95% acrylic acid). In the peel test, the adhesion shown was in the range 0.005–0.02 N/mm.

EXAMPLE 4

Use of Several Different Polar Monomers

The polyethylene blend comprised polyethylene with 49% of an ethylene-butyl acrylate copolymer and 20% "Modic" LI00F. In this case, the butyl acrylate quantity was 12.74% and the maleic anhydride quantity 0.008%. When a co-extruded film of this blend and polyamide 12 was subjected to the peel test, the results were 0.19–0.25 N/mm, a very good result.

The example was repeated, holding the ethylene-butyl acrylate proportion constant and increasing the quantity of "Modic" L100F from 20 to 25% (i.e., the maleic anhydride content from 0.008% to 0.01%). It was found that the peel strength nearly doubled.

EXAMPLE 5

Use of a Polymer for Property Modification

Example 2 was repeated with the addition to each polyethylene blend of 2% by weight of "Fortirez" (trade mark) 500, a maleinised polybutadiene having a maleic content of 20%, and 5% of a butyl rubber (Butyl 268 ex Exxon Corp.) When the peel test was conducted, the samples all exhibited cohesive failure of the type described in Example 3. In addition, the composition passed the stress crack test of Australian Standard 1049. A composition with the butyl rubber omitted failed this test.

We claim:

1. A process of manufacture of a cable comprising at least one elongate functional element which is coated with at least two concentric layers of polymeric material, the exterior layer comprising at least one polyamide of high surface gloss, hardness and resistance to formic acid, and the inner layer immediately adjacent to the exterior layer comprising essentially olefin polymer which comprises from 0.001% to 30.0% by weight of polar monomer selected from unsaturated acids and acid anhydrides, the layers being applied in a single operation wherein at least one of the polymeric materials is in a fluid state when the two polymeric materials are contacted.

2. A process according to claim 1, wherein the proportion of polar monomer present in the olefin polymer is from 0.001–5.0% by weight.

3. A process according to claim 1, wherein the proportion of polar monomer present in the olefin polymer is from 0.01–5% by weight.

4. A process according to any one of claims 1–3, wherein the olefin polymer comprises up to 30% by weight of non-olefinic monomers.

5. A process according to claim 4, wherein the non-olefinic monomer is vinyl acetate.

6. A process according to claim 1, wherein the olefin polymer comprises up to 50% by weight of property-modifying polymers.

7. A process according to claim 6 wherein the property modifying polymers are selected from styrene block copolymer rubbers, EPR, EPDM, butyl rubber and urethane rubber.

8. A process according to claim 1, wherein the two layers are extruded from a single die.

9. A process according to claim 1, wherein the olefin polymer is in a fluid state when the two layers are contacted.

10. A process according to claim 9, wherein the olefin polymer is at a temperature of 180° C. minimum.

11. A process according to claim 9 or claim 10, wherein the olefin polymer is at a temperature of 220° C. minimum.

12. A process according to claim 1, comprising the steps of covering at least one functional element in aluminium foil, followed by the coating of the foil with the inner and exterior layers.

13. A process according to claim 1, wherein at least one elongate functional element is coated first in waterproofing jelly optionally by coating tape, and the taped element has then applied thereto the inner and exterior layers.

14. A cable which comprises at least one elongate functional element which is coated with at least two concentric layers of polymeric material, the outer layer comprising at least one polyamide of high surface gloss, hardness and resistance to formic acid, and the inner layer adjacent to that outer layer comprising essentially olefin polymer which comprise from 0.001% to 30.0% by weight of polar monomer selected from unsaturated acids and anhydrides, the outer layer being less than 2 mm thick.

15. A cable according to claim 14, wherein the outer layer has a thickness of less than 0.5 mm.

16. A cable according to claim 14, wherein the outer layer has a thickness of less than 0.25 mm.

17. A cable according to any one of claims 14–16, wherein the proportion of polar monomer present in the olefin polymer is from 0.001–5.0% by weight.

18. A cable according to any one of claims 14–16, wherein the proportion of polar monomer present in the olefin polymer is from 0.01–5% by weight.

19. A cable according to claim 14, wherein the olefin polymer comprises up to 30% by weight of non-olefinic monomers.

20. A cable according to claim 19, wherein the non-olefinic monomer in vinyl acetate.

21. A cable according to claim 14, wherein the olefin polymer comprises up to 50% by weight of property-modifying polymers.

22. A cable according to claim 21 wherein the property modifying polymers are selected from styrene block copolymer rubber, EPR, EPDM butyl rubber and urethane rubber.

23. A cable according to claim 14, wherein the cable comprises at least one elongate functional element which is covered as hereinabove described with aluminium foil free from any olefin-adhesive layer, on which foil is directly applied the inner layer.

24. A cable according to claim 14, wherein the cable comprises at least one functional element coated successively with waterproofing jelly, coating tape, inner layer and exterior layer.

* * * * *